US005615971A

United States Patent [19]

Boevé

[11] Patent Number: 5,615,971

[45] Date of Patent: Apr. 1, 1997

[54] GROUNDCOVERING ELEMENT, METHOD FOR ITS MANUFACTURE AND METHOD FOR THE MANUFACTURE OF A MOULD TO BE APPLIED WITH THE MANUFACTURING METHOD

[76] Inventor: Jan A. Boevé, Burg. Vrylandweg 1, 6997 AB Hoog-Keppel, Netherlands

[21] Appl. No.: 423,355

[22] Filed: Apr. 18, 1995

[51] Int. Cl.[6] ..... E01C 5/06

[52] U.S. Cl. ..... 404/37; 47/33; 52/102; 405/19

[58] Field of Search ..... 405/19, 20, 258; 47/25 R, 25, 33; 404/7, 36, 37; 52/102, 388

[56] References Cited

U.S. PATENT DOCUMENTS

| | | | |
|---|---|---|---|
| 4,197,684 | 4/1980 | Johnson | 52/102 |
| 5,027,551 | 7/1991 | Rodriguez | 52/102 X |

FOREIGN PATENT DOCUMENTS

| | | | |
|---|---|---|---|
| 0004364 | 5/1983 | European Pat. Off. . | |
| 152232 | 8/1985 | European Pat. Off. | 405/19 |
| 587195 | 10/1933 | Germany | 47/33 |
| 2932600 | 2/1981 | Germany . | |
| 3038843 | 5/1982 | Germany . | |
| 3228308 | 2/1984 | Germany . | |
| 3405628 | 7/1986 | Germany . | |
| 4138564 | 5/1993 | Germany | 404/37 |
| 212523 | 10/1985 | Japan | 405/19 |
| 258116 | 11/1971 | U.S.S.R. | 405/20 |
| 2139676 | 11/1984 | United Kingdom | 405/20 |
| 2212195 | 7/1989 | United Kingdom . | |
| 93/07339 | 4/1993 | WIPO . | |

*Primary Examiner*—David J. Bagnell
*Attorney, Agent, or Firm*—Larson and Taylor

[57] ABSTRACT

The invention relates to a groundcovering element, consisting of a plurality of components (1) with links (2,3) in between, a method for the manufacture thereof and a method for the manufacture of a mold (24, 25, 26, 27, 29, 30). According to the invention it is provided that the links between the components are deformable, possibly flexible and allow for a distance between adjacent components, resulting in a groundcovering element that is easy to lay, offers better possibilities of adjustment to various desired surfaces to be covered and is considerably more suitable for a more or less undulating terrain. In a method of manufacture, one steel mold part (34) cooperates with many rubber ones (31), so that with little investment a high production rate is obtained.

13 Claims, 6 Drawing Sheets

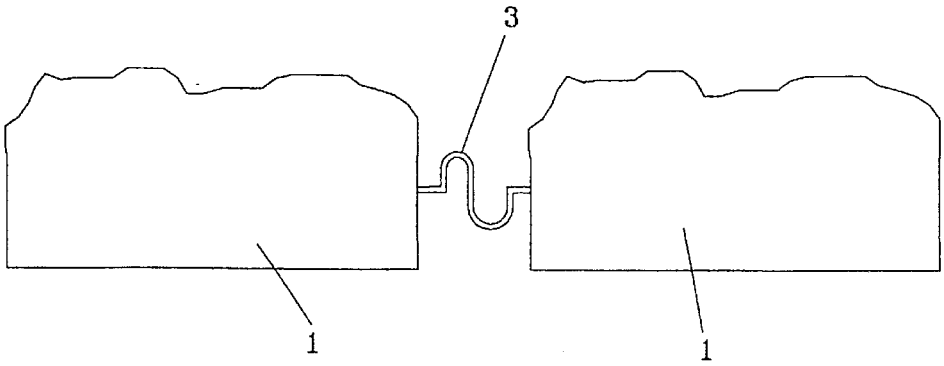
FIG. 8
FIG. 9a
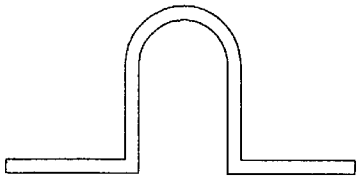
FIG. 9b
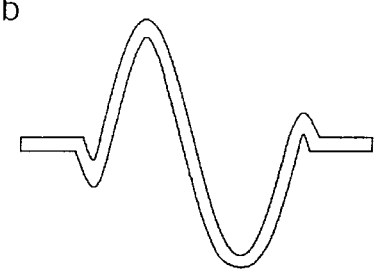
FIG. 9c
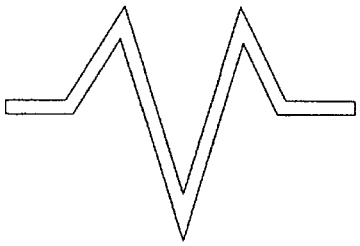
FIG. 9d
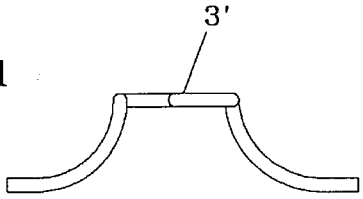

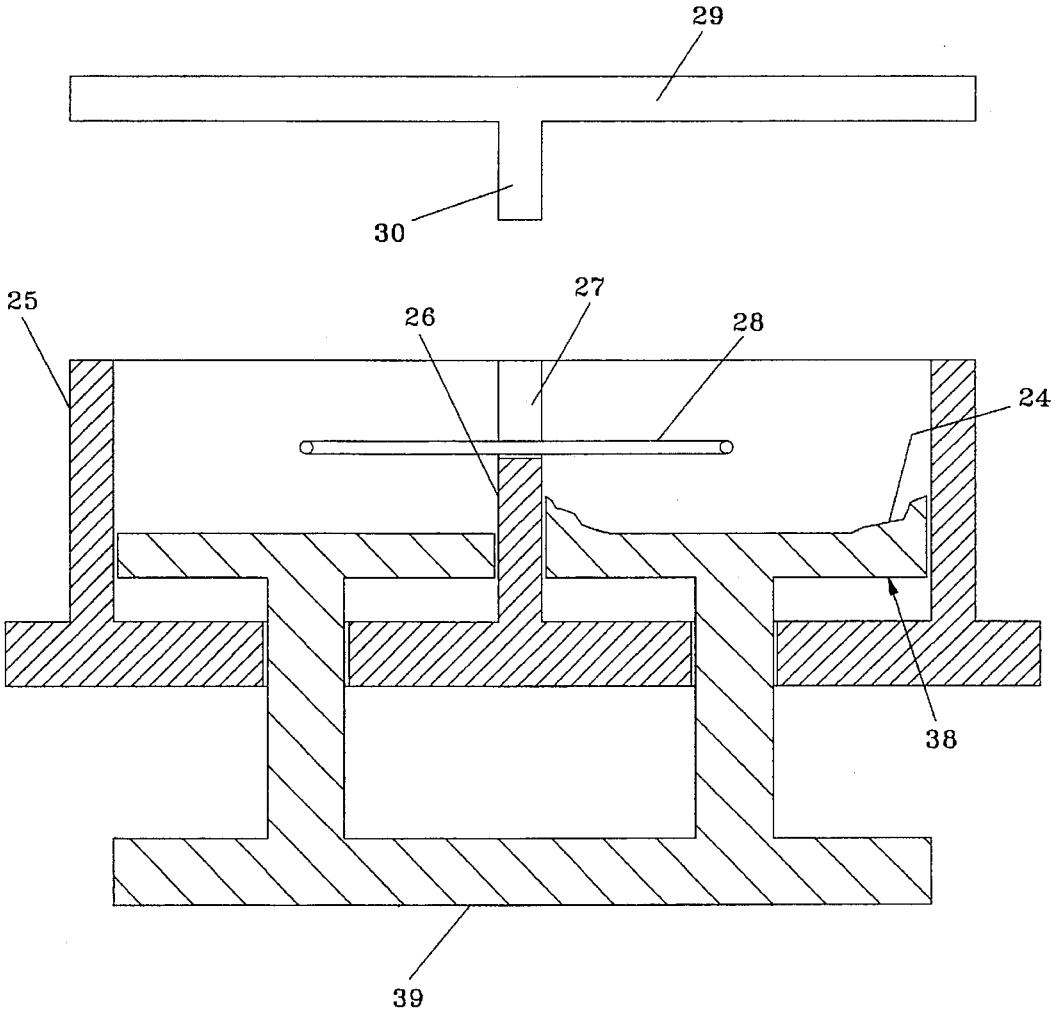
FIG. 12
FIG. 13
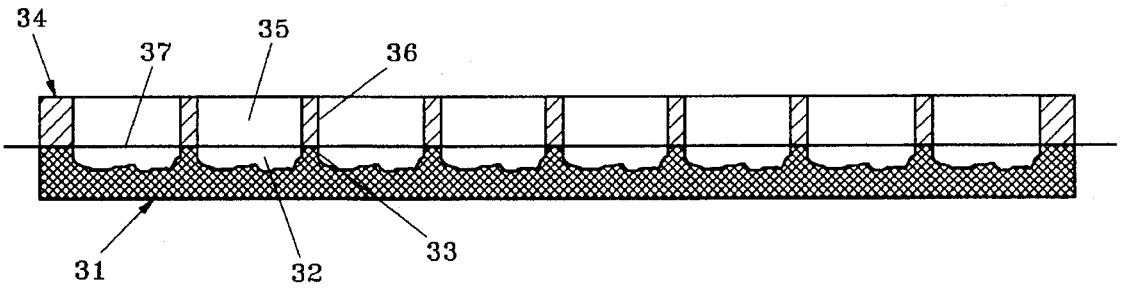

GROUNDCOVERING ELEMENT, METHOD FOR ITS MANUFACTURE AND METHOD FOR THE MANUFACTURE OF A MOULD TO BE APPLIED WITH THE MANUFACTURING METHOD

The invention relates to a groundcovering element, consisting of a plurality of components with links between such components.

Such a groundcovering element is known from the European patent specification EP-B-0.004.364. This known element consists of components, with rigid linking elements in between, so that the element as a whole is rigid. As a reinforcement of the this rigid structure a mesh of thin threads is accommodated in the bottom of the components and connects them.

The rigid linking elements ensure a sufficient bond between the components, so that larger elements comprising a plurality of components can be laid, which preferably happens mechanically. The link between the components can subsequently be broken by vibration, the mesh situated with said linking elements then being cut as well.

Also the international patent application WO 93/07339, the European patent application EP-A-0.004.364 and the British patent specification GB-A-2.212.195 show such groundcovering elements consisting of components, all of which have an inflexible link between the components and/or components touching each other. This leads to rigid links.

Said known groundcovering elements, however, have for many applications a number of disadvantages. The first is that handling such an in principle inflexible element without the appropriate machines, such as is often the case for example when laying out gardens or parks, is difficult, especially because the various components are to rest evenly on the ground. A further disadvantage is that the elements are relatively difficult to adjust to certain designs of the desired groundcover, the more so because the links are not easily broken by hand. When, for example, it is desired to lay half a circle in front of a tree and, in case of a thicker tree, an inner row of elements can be omitted, it is hard work to break off and disengage such components one by one. It may also happen that in covering a surface it is desired that various elements interlock by alternately removing components at the edge. The most important difficulty in incorporating groundcovering elements as indicated hereinabove in gardens, however, is constituted in that it is very difficult to adjust them to a more or less undulating soil profile.

The invention aims at removing said difficulties and at providing for a groundcovering element which is easy to lay, offers better possibilities of adjustment to various desired surfaces to be covered and is considerably more suitable for a more or less undulating terrain.

The aforementioned objectives are attained by providing that the links are deformable and allow for some distance between adjacent components.

By reason hereof the angular position of a component with respect to an adjacent component can be varied, as well as the distance between such components.

A further elaboration hereof is constituted in that the links are part of a deformable mesh incorporated in a plurality of components.

Such links preferably consist of one or more flexible cords or threads of a material not susceptible to rot. Suitable materials are here in particular plastics, which are virtually always rot resistant, are elastic in various degrees and can have a relatively high tensile strength, without wear and tear or fatigue fractures being to be expected.

In applying the invention the height at which the links are situated is not of vital importance. In order, however, to obtain a sufficient flexibility in two directions, upward and downward so to speak, it is preferred that the links are attached at ⅔ to ⅓ of the height, measured from the bottom side of the components, but attachment at the bottom side may simplify the production method.

In general, sufficient flexibility can be combined with sufficient shape stability of the elements by providing that the links between the side surfaces of the components have a length of 0.5–2 cm.

Links in the form of cords and threads are preferably embedded in the material the components are made of, which is cured afterwards. Attachment to for instance the bottom plane is, however, also possible.

An important application of the invention is constituted in the imitation of natural stone in a way as true to nature as possible. Not only can a cast be made of real pieces of natural stone, such as basalt, having the same shape and the typical fracture and relief properties of the natural stone, also the colour can be imitated by tinting the material to be cured. These materials are in general very colourfast and, although the result does not completely show the colour of the natural stone, the approximation is nevertheless a real surprise.

In the invention the components may be pavement elements, but it is also possible to use them as a palisade or the like when covering slanting or vertical walls, or even to put them upright so as to form for example a flower box. In the latter case the components may have the shape of straight or curved pickets.

In applying the invention the link usually need to be deformed only once. Consequently, the links need not be flexible, but being deformable may be sufficient.

Accordingly, the links can be of plastic or metal wire and in that case need to be bent only once for the desired adjustment to the surroundings. Such elements have been found to allow considerable savings of labour in the production.

An embodiment of the invention, which in particular permits a more economical production, is constituted in that the links are part of a flexible mesh incorporated in a plurality of components. As a result a considerable saving of labour can be obtained because with such a flexible mesh all links can be realized in one time. Such a mesh ensures a high degree of flexibility in a vertical plane, but also allows, albeit with some limitations, adjustment in horizontal direction of the mutual position of adjacent groundcovering elements. Said embodiment of the invention is generally labour-saving and offers in particular the possibility of proceeding to a completely mechanised production of the elements according to invention.

In accordance with a further elaboration of the invention it can be provided that the links have a curved shape, such as a helical line, an undulating line or a U-bend. Thus a considerable adjustment of the mutual position of adjacent components is possible, whereas nonetheless relatively sturdy linking elements can be used. Said embodiment can especially be realized by the application of a flexible mesh, because, for instance when made of plastic, such a mesh provided with the indicated forms of the linking elements can be easily manufactured by means of injection moulding. In this manner also metal-wire meshes can be relatively simply manufactured from bent wires and the like.

In applying the invention the linking elements may be of flexible plastic, but also of metal such as copper wire, steel wire (preferably stainless steel) or galvanised steel. Of course, a material not to be affected in the soil is preferred.

In manufacturing the elements according to the invention it has been found favourable to carry this out in such manner that a curable material is poured into a mould with cavities that correspond with the desired components in mutual arrangement, and between the cavities walls, while at desired heights deformable elongated linking elements, passing the walls, are led through the cavities, that the curable material is at least partially cured and that subsequently the entirety is disengaged from the mould. Here it is preferably provided that in these walls slits have been made into which the linking elements are placed. It is now surprising that it is generally not difficult to cover the slits with loose small caps, but in particular that when using elastic moulding material is it possible to press the cords into the slits and that, with the removal of the moulded groundcovering element, it is easy to withdraw it from the mould in the direction of the slits.

Finally the invention also comprises a method for the manufacture of a mould for the application of the aforementioned method, which is constituted in that an elastic mould is made of a plurality of model elements in the desired mutual arrangement, that of same mould a cast is made of a curable material, that said cast is finished at the base until a desired bottom surface of the cast has been obtained, and that of same finished cast a final mould is made, in which, if need be, in the desired places slits are made in the walls of the final mould, which are suitable to accommodate deformable links. In applying said method, it is possible to form a plurality of final moulds of the finished cast, which naturally fall under the present invention as well.

The invention will hereinafter be further explained, reference being made to the drawing, where:

FIG. 1 schematically shows a plan view of a part of the element according to the invention;

FIG. 2 shows a plan view of another embodiment of the invention;

FIG. 3 schematically shows a vertical cross-section of an element on a sloping ground;

FIG. 8 shows another embodiment of a link;

Figure 10:
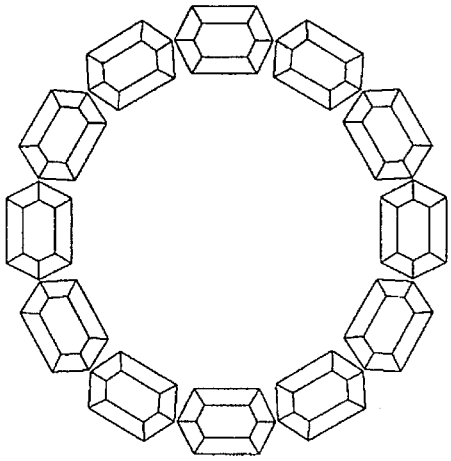

FIG. 9 explains variations of FIG. 8;

FIG. 10 shows another embodiment; and

Figure 14A:
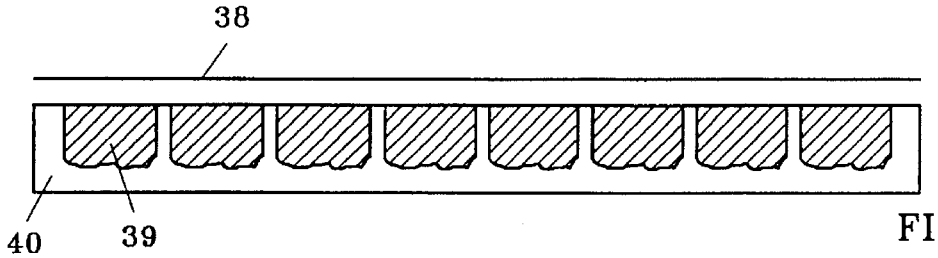
Figure 14B:
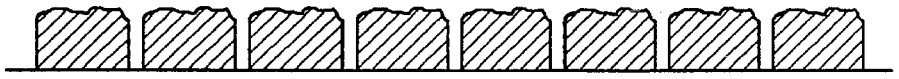
Figure 15A:
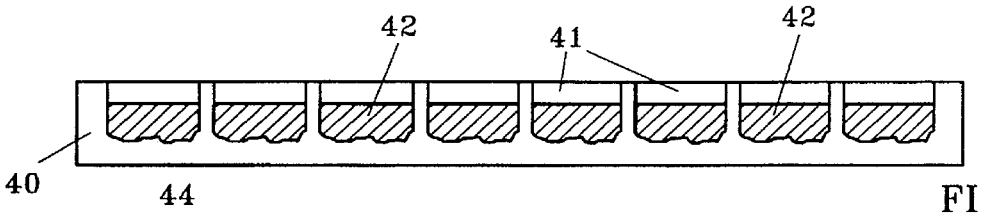
Figure 15B:
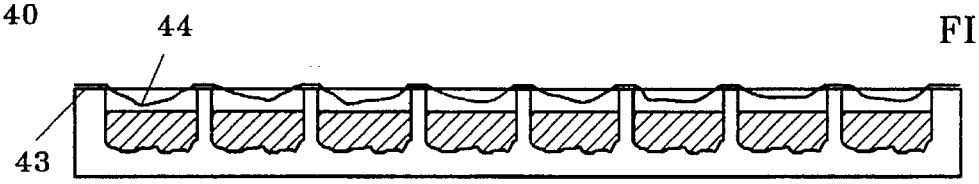
Figure 15C:
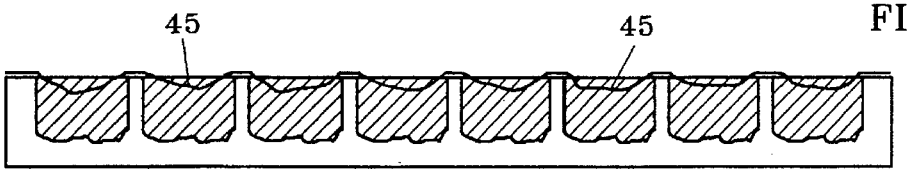
Figure 16:
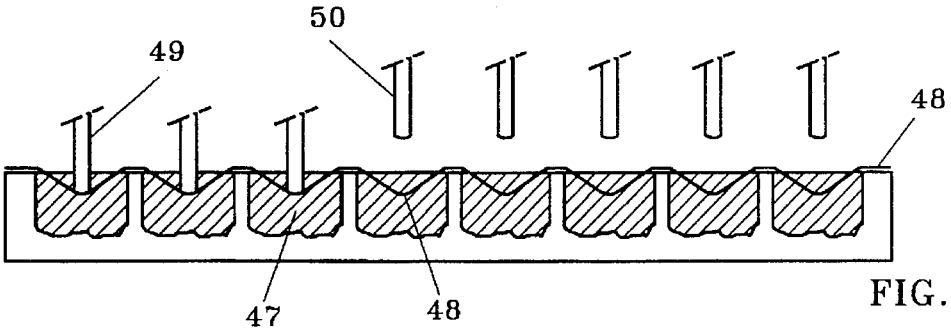

FIGS. 11*a* through 11*d* show four different stages of the manufacture of a mould for casting an element according to the invention;

FIG. 12 schematically shows a mould which makes automated production possible of groundcovering elements according to the invention;

FIG. 13 shows a mould which enables a further automated method of production;

FIG. 14*a* and 14*b* show some related embodiments of the invention;

FIG. 15*a*, 15*b* and 15*c* show a further embodiment of the invention; and FIG. 16 elucidates still another embodiment.

Figure 1:
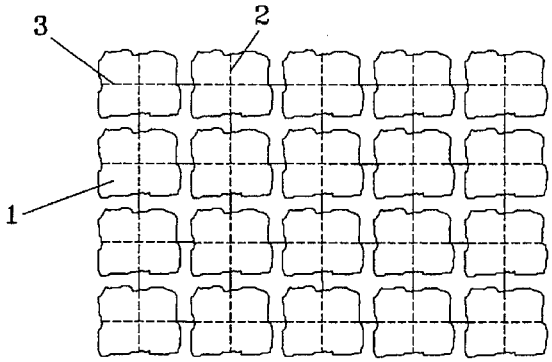

In FIG. 1 a plurality of components 1, shaped either at random or regularly, are connected by means of cords 2 in one direction and cords 3 in a direction perpendicular thereto. The cords are flexible and allow small displacements in a horizontal or vertical plane, small rotations in a horizontal plane and slightly larger ones in a vertical plane.

Figure 2:
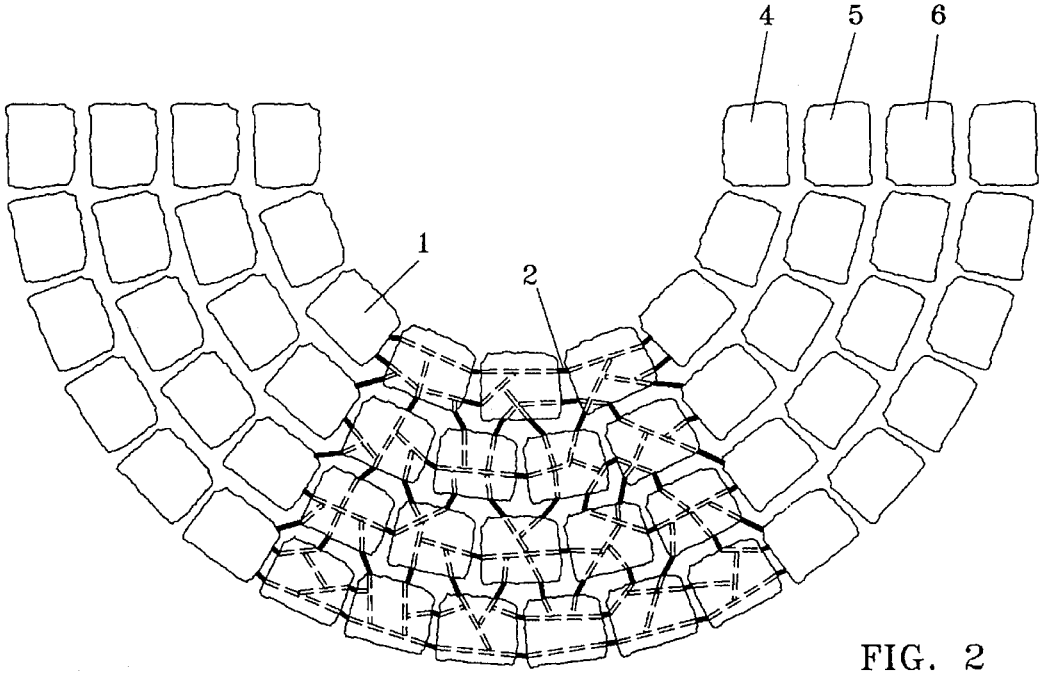

FIG. 2 shows an embodiment preferably suitable for laying a groundcovering element in front of a tree.

In case of a relatively thin tree the three rows 4, 5 and 6 are used, but with a thicker tree row 4 is omitted and the outside row is used. It is even possible to lay just one row, for example row 6.

Figure 3:
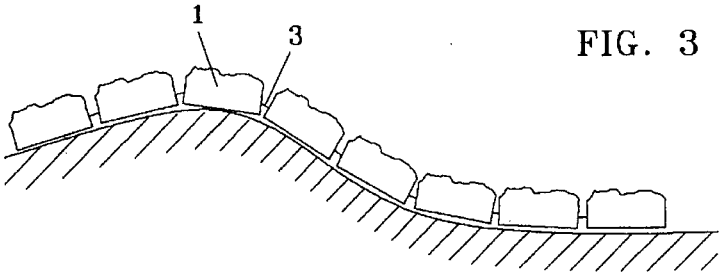
Figure 4:
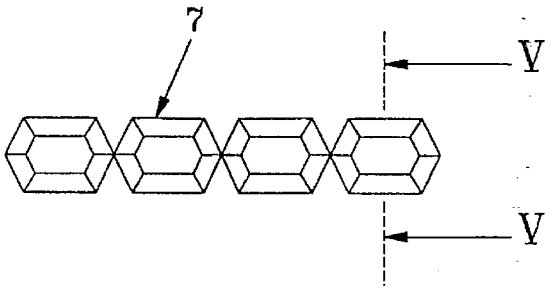
FIG. 4 shows a plan view of an embodiment.
Figure 5:
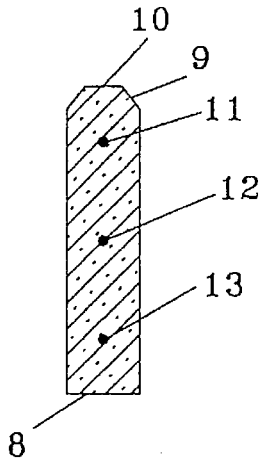
FIG. 5 is a cross-section of FIG. 4 over the line V—V.
Figure 6:
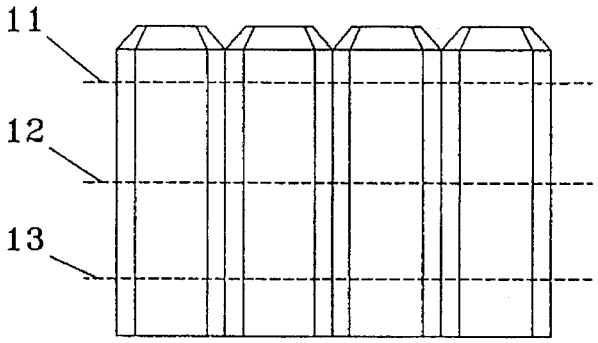
FIG. 6 is a front view of FIG. 4.

In the vertical cross-section, as shown in FIG. 3, the elements 1 are connected by links indicated by 3. This offers the opportunity to follow the slopes in the terrain, which is a very important advantage, in particular for laying out gardens.

FIGS. 4 through 7 show an embodiment in which the components are in principle pickets. Hexagonal pickets 7, more or less corresponding with the shape of basalt, have been drawn in plan view in FIG. 4 and in cross-section over the line V—V in FIG. 5.

The pickets have a flat bottom side 8 and at the upper side a bevel 9 with an upper surface 10. The pickets may be connected for example at three heights with cords 11, 12, 13, as can also be seen in the elevational view of FIG. 6.

Naturally, such pickets need not have a hexagonal diameter, but they may also be elliptic or circular, as well as diamond-shaped, etcetera.

Figure 7:
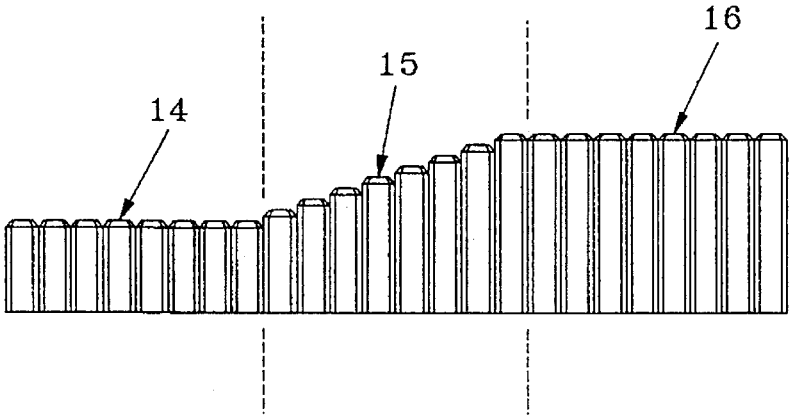
FIG. 7 shows an elevational view of a number of elements according to FIG. 4 in a practical application.

In FIG. 7 an embodiment has been drawn, in which elements according to the invention, composed of pickets, are used to shield an earth wall increasing in height. In FIG. 7 to the left there is a relatively small rise, which is shielded by short pickets of the element 14; subsequently there is a rise increasing in height with an element comprising pickets 15 increasing in height, and finally an element with relatively long pickets of equal height 16.

FIG. 8 shows an embodiment with a link 3 by shape of a bendable wire, which has been bent up and down and consequently allows a considerable displacement in horizontal direction and a relatively wide angular displacement.

Other examples of such a link have been drawn in FIGS. 9*a* through 9*d*. In FIG. 9*d* not only is bending present in the plane of drawing, but also the portion 3' is hairpin-shaped, which makes great deformations possible.

In FIG. 10 a plan view has been drawn of a flower box or the like, constructed by means of pickets according to the invention. It has been observed that from flower boxes constructed accordingly, when filled with earth, no earth leaks out and can therefore be considered very satisfying flower boxes.

In FIGS. 11*a* through 11*d* the subsequent steps have been represented to obtain a mould suitable for casting elements, the shape on the visible side entirely corresponding with those of the models chosen for that purpose.

Figure 11A:
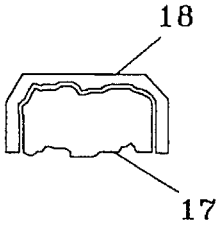

FIG. 11*a* shows such a model 17, for instance of natural stone. By 18 a mould has been indicated which has been fitted thereon and is made for example of elastic material that can be poured.

Figure 11B:
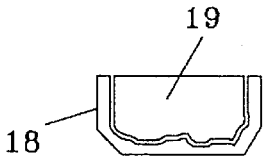
Figure 11C:
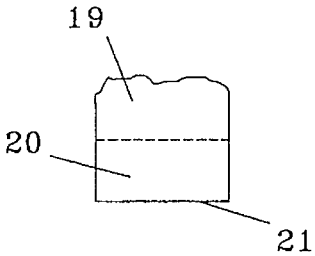

In FIG. 11*b* the mould 18 has been turned and in it an artificial element 19 has been cast. After same element has been taken from the mould, a base 20 may be added, which gives the upper side 19 a desired height above the ground surface 21 of the addition 20.

Figure 11D:
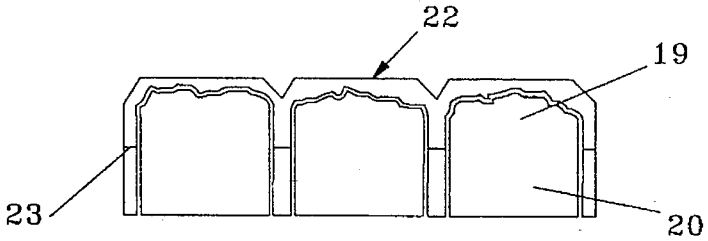

Over a plurality of adjacent elements 19, 20 a mould 22 is sprayed, as is shown in FIG. 11*d*. After said mould has been removed from said models, it may be used as a mould for elements according to the invention, often after cuts 23 have been made in the mould, on the bottom of which a link 3 is laid prior to filling up the various cavities of the mould. After this has happened and the poured material has been cured, the various elements may be removed by retiring them in the direction of the slits 23.

It has been found that in case of a plastic material such a slit 23 may be a simple cut and, because said cut is located at the bottom side of the element to be cast, any irregularities at such cut are not of any importance. Nonetheless, these irregularities may be concealed by covering a cut. Moreover, when the elastic material is well chosen, hardly any irregularities at the cut occur.

A method for the automated manufacture of the groundcovering elements in accordance with the invention will hereinafter be explained, reference being made to FIGS. 12 and 13.

The mould, in which a groundcovering element according to the invention can be manufactured, has been schematically represented in FIG. 12. Such mould has a bottom plate 38 which can be moved up and down by means of a power engine 39 not drawn in detail. The plate 38 may be adapted to the upper side of the respective component, as has schematically been indicated by the line 24. For the manufacture of simple rectangular components, such filling as indicated by the line 24 need not be applied.

In the drawn embodiment the mould cavities for only two components have been indicated in cross-section. These have for instance an outer wall 25 made of steel and a partition wall 26. In same partition wall a cut 27 has been made where the link 28 is led through. A stamp 29 provided with an extrusion 30 that corresponds with the recess 27, is moved downward after the cavities between the walls 25 and 26 have been filled with curable material, so that no curable material forms a direct link between both components and the link 28 can be easily disengaged. The procedure when using the mould press according to FIG. 12 is constituted in that, after the plate 38 has been moved downward, the mould cavities are filled with curable material, preferably relatively dry concrete mortar, and a mesh of linking elements 28 is accommodated. Naturally, it is also possible to fill up the mould first almost half way, then to accommodate the mesh and subsequently to complete the filling procedure. Then the stamp 29 is moved down and, after a possible short curing period, moved up again, whereupon the cast groundcovering element can be ejected due to the upward motion of the plate 38. This is preferably done by covering the mould with a receiving or curing plate and, after the stamp has been removed, by turning over the entirety and enabling the cast groundcovering element to cure.

In FIG. 13 a rubber plate has been indicated by 31, which has mould cavities 32 having the shape of the top of components, provided with partition walls 33. A plate 34 preferably of steel has holes 35 with in casting position vertical partition walls 36 that engage the partition walls 33.

After laying down the rubber plate 31 with the cavities 32 turned upward, a mesh 37, for example made of plastic string, metal wire etcetera, is accommodated and subsequently the plate 34 is lowered. Then the cavities 32 and the openings 35 are filled with preferably rather firm concrete mortar. After vibration the plate 34 can be lifted fairly soon and removed for reuse with another plate 31. After a curing period of for example 24 hours, the element can be disengaged from the cavities 32, preferably after having been turned over. The procedure indicated hereinabove offers the possibility of using, against one single plate 34, a great quantity, for example 500 to 700, of considerably less expensive rubber plates 31, making a high production rate possible with a limited investment.

FIGS. 14*a* and 14*b* show an embodiment in which the links consist in a mesh, fleece or preferably perforated foil 38, which in FIG. 14*a* is laid on components 39 in a mould 40. These components may be attached to the mesh, fleece or foil 38 by any suitable means, such as gluing. It is also possible to roll for instance the mesh or fleece into the still plastic mass of the components 40.

In FIG. 15*a* the cavities 41 in the mould 40 are partially filled with curable material 42. FIG. 15*b* shows a mesh 44 or suchlike member, that is laid on the upper side 43 of the walls of the mould. The mesh sags down and when additional curable material is poured into the cavity takes a shape as indicated at 45 in FIG. 15*c*. Of course the used curable materials may be the same or different.

FIG. 16 shows a mould 46 filled a curable material 47. A mesh 48 is laid over the mould and pressed into the curable material by means of punches, which may move downward (punch 49) or again upward (punch 50). The punches generally have a surface area that is small in comparison to that of the cavities of the mould. A narrow elongated shape or even the shape of a slender cross may be used.

In laying the groundcovering element, for example on a ground reinforced by a little cement, it is possible to adjust to a certain degree the mutual position of the components, curves in a vertical plane no longer presenting any difficulty either.

I claim:

1. A groundcovering element comprising:

a plurality of components; and links positioned between said components for providing a distance between adjacent components, said links having a curved shape for allowing the distance between adjacent components to be increased by straightening said curve or decreased by tightening said curve, said links comprising a deformable material selected from the group consisting of bendable plastic or metal.

2. Groundcovering element as claimed in claim 1, in which the links are part of a deformable mesh incorporated in a plurality of components.

3. Groundcovering element as claimed in claim 1, in which the links are located at ⅔ to ⅓ of the height, measured from a bottom side of the component.

4. Groundcovering element as claimed in claim 1, in which the components have a bottom surface and the links are attached to said surface.

5. Groundcovering element as claimed in claim 4, in which the links at the location of the components are embedded in the components.

6. Groundcovering element as claimed in claim 1, in which the free length of the links between the side surfaces of the components is 0.5–2 centimeters.

7. Groundcovering element as claimed in claim 1, in which the links inside the components are embedded in a cured material.

8. Groundcovering element as recited in claim 7 wherein said cured material comprises concrete or plastic.

9. Groundcovering element as claimed in claim 1, in which the components are made of tinted cured material.

10. Groundcovering element as claimed in claim 1 in which the components have the color of natural basalt.

11. Groundcovering element as claimed in claim 1, in which the components are pavement elements.

12. Groundcovering element as claimed in claim 1, in which the components have the shape of pickets.

13. Groundcovering element as recited in claim 1 wherein the shape of said links is selected from the group consisting of a helical line, an undulating line and a U-bend.

* * * * *